US010415308B1

(12) United States Patent
Penhallegon et al.

(10) Patent No.: US 10,415,308 B1
(45) Date of Patent: Sep. 17, 2019

(54) LATCHING GATE SYSTEM

(76) Inventors: Michael Penhallegon, Largo, FL (US); Gregory May, Largo, FL (US)

( * ) Notice: Subject to any disclaimer, the term of this patent is extended or adjusted under 35 U.S.C. 154(b) by 20 days.

(21) Appl. No.: 12/930,903

(22) Filed: Jan. 19, 2011

Related U.S. Application Data

(60) Provisional application No. 61/456,284, filed on Nov. 4, 2010.

(51) Int. Cl.
*E06B 1/04* (2006.01)
*E06B 11/02* (2006.01)

(52) U.S. Cl.
CPC ..... *E06B 11/027* (2013.01)

(58) Field of Classification Search
USPC ..... 49/394, 467, 468, 501, 504; 256/73
See application file for complete search history.

(56) References Cited

U.S. PATENT DOCUMENTS 3,298,134 A * 1/1967 Overby ..... 49/394
3,374,579 A * 3/1968 Neff ..... 49/468
3,949,526 A * 4/1976 Sherlock et al. ..... 49/501
4,074,464 A * 2/1978 McCay ..... 49/468
4,927,134 A * 5/1990 Burley ..... 472/90
5,029,911 A * 7/1991 Daniels ..... 292/170
5,623,783 A * 4/1997 Kenkel ..... 49/21
5,664,769 A * 9/1997 Sadinsky et al. ..... 256/73
6,530,183 B1 * 3/2003 Kuei-Yung ..... 52/204.1
6,666,435 B2 * 12/2003 Blosfelds ..... 256/73
6,684,570 B1 * 2/2004 Robledo ..... 49/394
6,964,131 B2 * 11/2005 Herrmann et al. ..... 49/193
7,147,213 B1 * 12/2006 Amendola ..... 256/73
7,661,226 B2 * 2/2010 Kibbel et al. ..... 49/382
7,686,283 B2 * 3/2010 Marchio ..... 256/73
7,765,741 B2 * 8/2010 Miller et al. ..... 49/394
2002/0046500 A1 * 4/2002 Hingston ..... 49/501
2003/0041521 A1 * 3/2003 Toth ..... 49/394
2004/0045222 A1 * 3/2004 Hicks ..... 49/394
2006/0150524 A1 * 7/2006 Kibbel et al. ..... 49/501
2006/0231821 A1 * 10/2006 Gavin ..... 256/73
2007/0022666 A1 * 2/2007 Andersen et al. ..... 49/394
2007/0131921 A1 * 6/2007 Monahan et al. ..... 256/73
2009/0183437 A1 * 7/2009 Chen ..... 49/504
2010/0293861 A1 * 11/2010 Ting et al. ..... 49/394

* cited by examiner

*Primary Examiner* — Katherine Mitchell
*Assistant Examiner* — Abe Massad

(57) ABSTRACT

An open latching gate frame configured in a rectangular configuration has upper and lower horizontal segments and two laterally spaced vertical segments. Each segment has an interiorly facing indentation. A panel insert has a rectangular configuration supported by the indentations of the segments. A first and a second vertically oriented, laterally spaced post has a hollow rectangular configuration. Hinges couple the first post to an adjacent vertical segment of the gate frame and panel inset. The hinges are spring urged and functioning to reciprocate the gate frame and panel insert between open and closed orientations.

4 Claims, 3 Drawing Sheets

FIG. 1
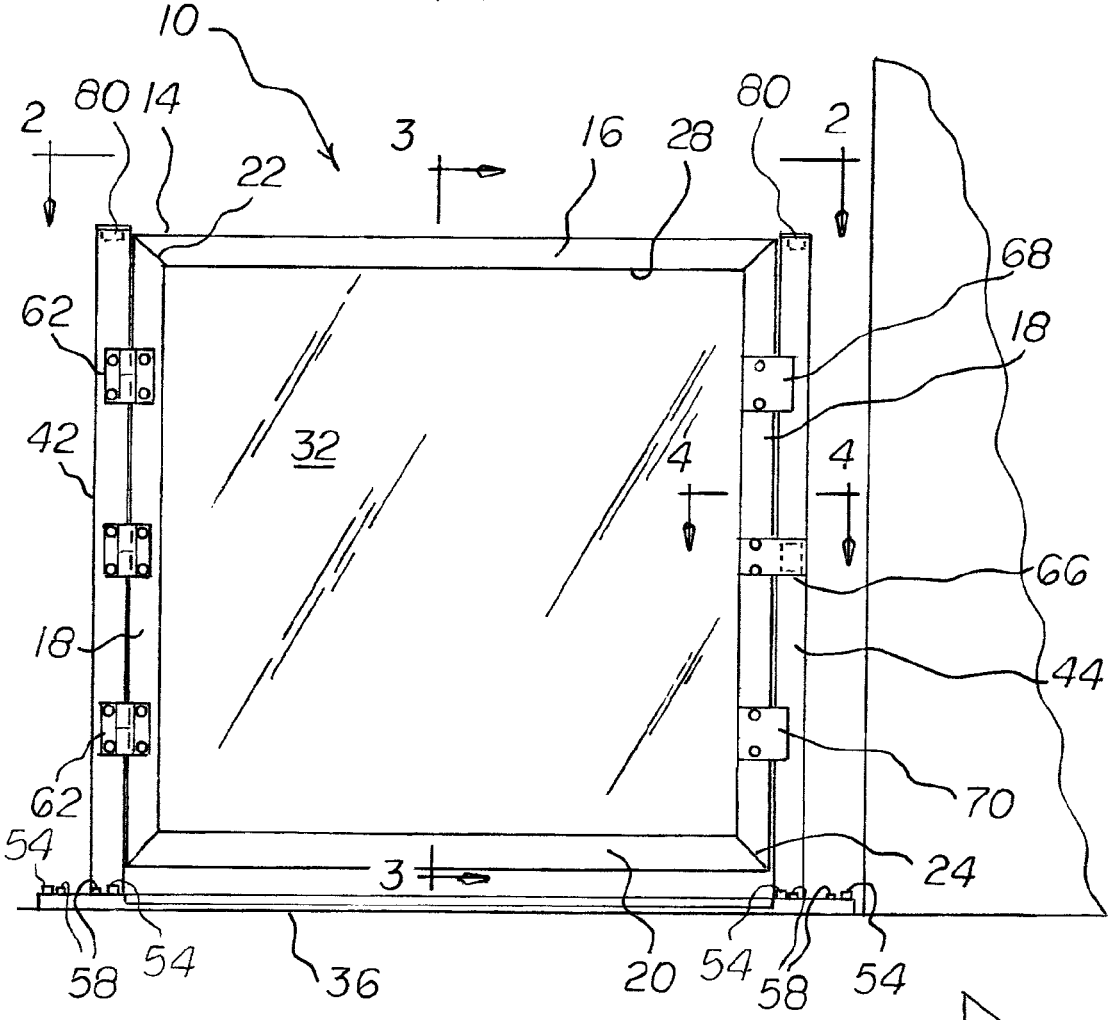
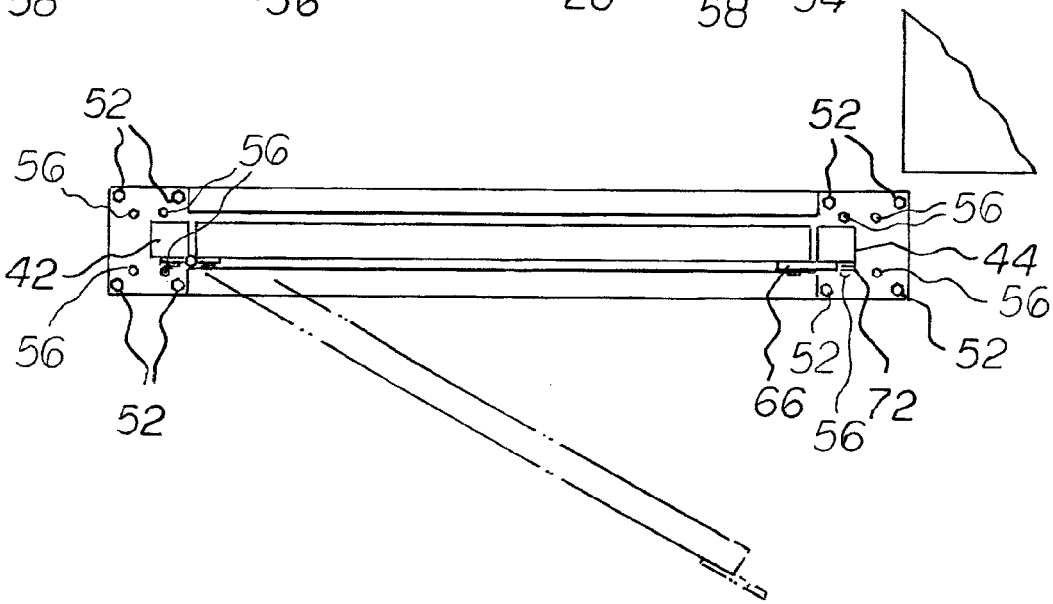
FIG 2

FIG. 5
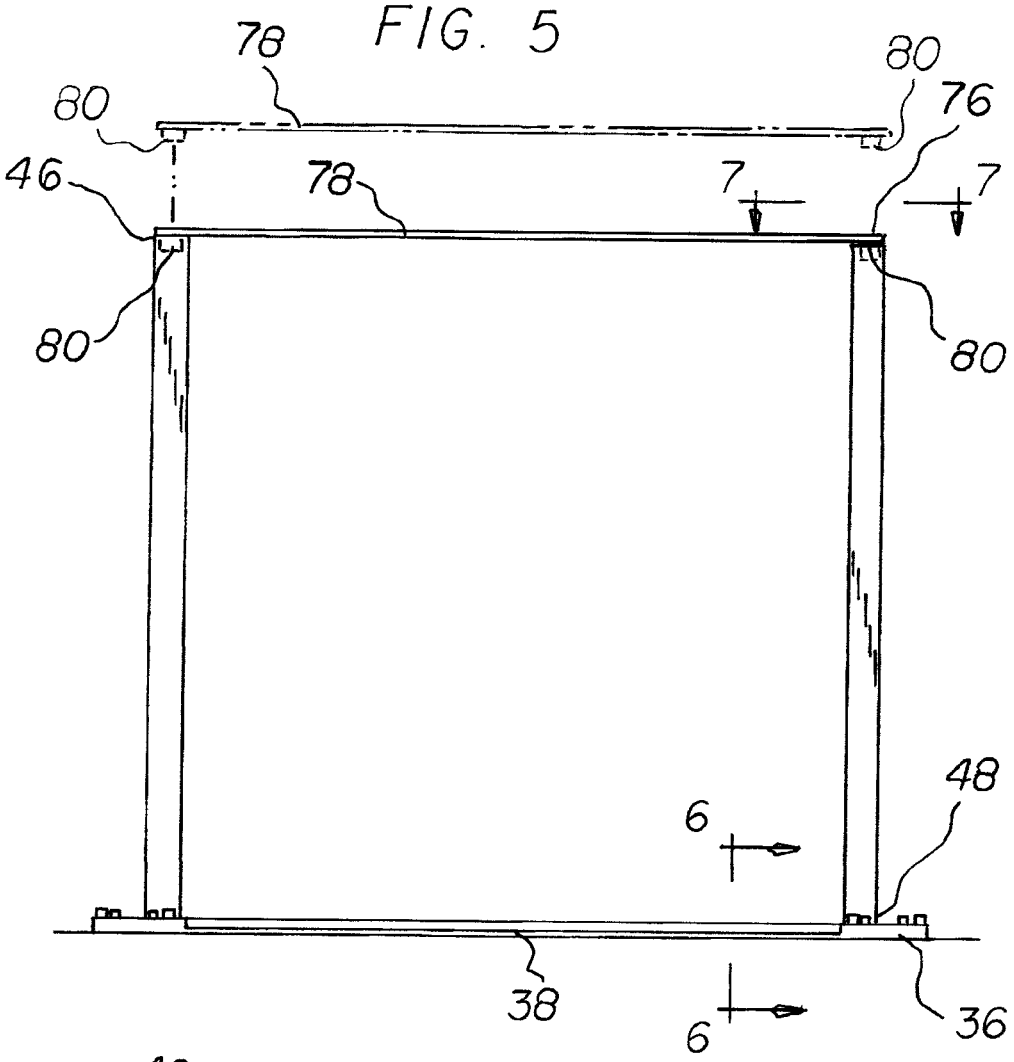
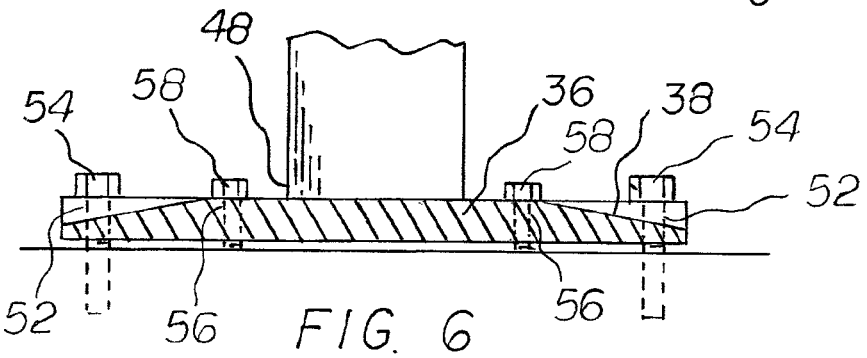
FIG. 6
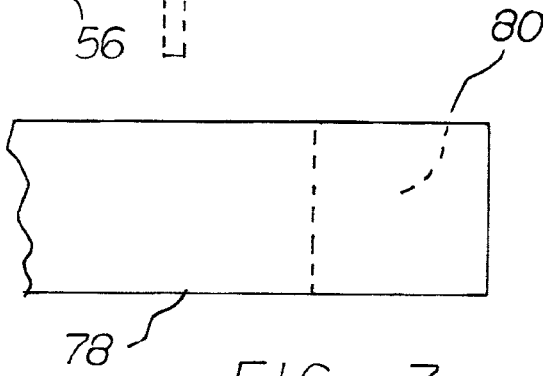
FIG. 7

LATCHING GATE SYSTEM

RELATED APPLICATION

The present non provisional patent application is a continuation-in-part application of provisional application Ser. No. 61/456,284 filed Nov. 4, 2010, the subject matter of which is incorporated herein by reference.

BACKGROUND OF THE INVENTION

Field of the Invention

The present invention relates to a latching gate system and more particularly pertains to controlling the location and movement of people such as travelers passing through airports, the controlling being achieved in a safe, secure, convenient and economical manner.

SUMMARY OF THE INVENTION

In view of the disadvantages inherent in the known types of gate systems of known designs and configurations now present in the prior art, the present invention provides an improved latching gate system. As such, the general purpose of the present invention, which will be described subsequently in greater detail, is to provide a new and improved latching gate system and method which has all the advantages of the prior art and none of the disadvantages.

To attain this, the present invention essentially comprises a latching gate system. First provided is an open latching gate frame. The frame is configured in a rectangular configuration. The frame has an upper horizontal segment. The frame has two laterally spaced vertical segments. The frame has a lower horizontal segment. The upper horizontal segment and the lower horizontal segment have 45 degree chamfered lateral ends. The vertical segments have 45 degree chamfered upper ends. The vertical segments have 45 degree chamfered lower ends. Upper weldments are provided. The upper weldments couple the lateral ends of the upper horizontal segment to the upper ends of the vertical segments. Lower weldments are provided. The lower weldments couple the lateral ends of the lower horizontal segment to the lower ends of the vertical segments. Each segment has a generally rectangular cross sectional configuration. Each segment has an interiorly facing C-shaped indentation. In this manner the latching gate frame creates a rectangular channel. The indentations all have a common width and depth. The gate frame is fabricated of a clear, shatterproof, scratch resistant acrylic for superior operational characteristics.

A panel insert is provided. The panel insert has a rectangular configuration. The panel insert has a width and a thickness essentially equal to the width and thickness of the indentations. The panel insert has an upper edge. The upper edge of the panel insert extends into the indentation of the upper horizontal segment. The panel insert has a lower edge. The lower edge extends into the indentation of the lower horizontal segment. The panel insert has side edges. The side edges extend into the indentations of the vertical segments. The panel insert is fabricated of a clear, shatterproof, scratch resistant acrylic for superior operational characteristics.

A latching gate base is provided. The base is provided in a rectangular configuration. The base has two parallel length edges and two parallel width edges. The latching gate base has a length greater than the length of the horizontal segments. The latching gate base is adapted to be supported upon a recipient surface. The recipient surface is chosen from the class of recipient surfaces. The class of recipient surfaces includes carpets, tiles, concrete and any of a plurality of recipient floor surfaces. The gate base has an upper surface. The upper surface is configured to form bevels. The bevels extend from the length edges. In this manner movement across the gate base and through the system is facilitated. The latching gate base has a length and a width. The length is between 5 and 10 times the width. The gate base being fabricated of aluminum.

A first and a second vertically oriented, laterally spaced post is provided. Each post has a hollow rectangular configuration. Each post has an upper end. Each post has a lower end. The lower ends are welded to the gate base. The lower ends are separated by a post spacing. The post spacing is greater than the width of the gate frame. The posts are fabricated of aluminum.

Four securement apertures are provided. The securement apertures extend through the gate base adjacent to each end. Eight securement screws are provided. In this manner the system may be secured to the recipient surface. Four adjustment apertures are provided. The adjustment apertures extend through the gate base adjacent to each end interiorly of the securement apertures. Eight adjustment screws are provided. In this manner the exact positioning of the frame base to the recipient surface is allowed.

Provided next are three hinges. The three hinges pivotably couple the first post to an adjacent vertical segment of the gate frame and panel inset. The hinges are spring urged. The hinges function to reciprocate the gate frame and panel insert between open and closed orientations. The hinges further function to automatically close the gate frame and panel insert through spring loading.

Further provided is a central stop plate. Two end stop plates are provided. The stop plates are coupled to the vertical segment adjacent to the second post. The stop plates are adapted to contact the second post when in a closed orientation. The second post has a magnetic latch. In this manner the central stop plate may be contacted for automatic securement of the gate frame and panel insert.

Provided last is an upper adjustment fixture. In this manner the initial securement and alignment of the posts with respect to each other and with respect to the gate base and the gate frame and the panel insert is facilitated. The adjustment fixture is formed of a horizontal plank. Two downwardly extending stubs are provided. The stubs are positionable in the upper ends of the posts.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved latching gate system which has all of the advantages of the prior art gate systems of known designs and configurations and none of the disadvantages.

It is another object of the present invention to provide a new and improved latching gate system which may be easily and efficiently manufactured and marketed.

It is further object of the present invention to provide a new and improved latching gate system which is of durable and reliable constructions.

An even further object of the present invention is to provide a new and improved latching gate system which is susceptible of a low cost of manufacture with regard to both materials and labor, and which accordingly is then susceptible of low prices of sale to the consuming public, thereby making such latching gate system economically available to the buying public.

Even still another object of the present invention is to provide a latching gate system for controlling the location and movement of people such as travelers passing through airports, the controlling being achieved in a safe, secure, convenient and economical manner.

Lastly, it is an object of the present invention to provide a new and improved latching gate system. An open latching gate frame configured in a rectangular configuration has upper and lower horizontal segments and two laterally spaced vertical segments. Each segment has an interiorly facing indentation. A panel insert has a rectangular configuration supported by the indentations of the segments. A first and a second vertically oriented, laterally spaced post has a hollow rectangular configuration. Hinges couple the first post to an adjacent vertical segment of the gate frame and panel inset. The hinges are spring urged and functioning to reciprocate the gate frame and panel insert between open and closed orientations.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a latching gate system constructed in accordance with the principles of the present invention.

FIG. 2 is a plan view of the system taken along line 2-2 of FIG. 1.

FIG. 5 is a front elevational view of the system prior to deployment.

FIG. 6 is a cross sectional view taken along line 6-6 of FIG. 5.

FIG. 7 is a plan view of a portion of the system taken along line 7-7 of FIG. 5.

The same reference numerals refer to the same parts throughout the various Figures.

DESCRIPTION OF THE PREFERRED EMBODIMENT

Figure 3:
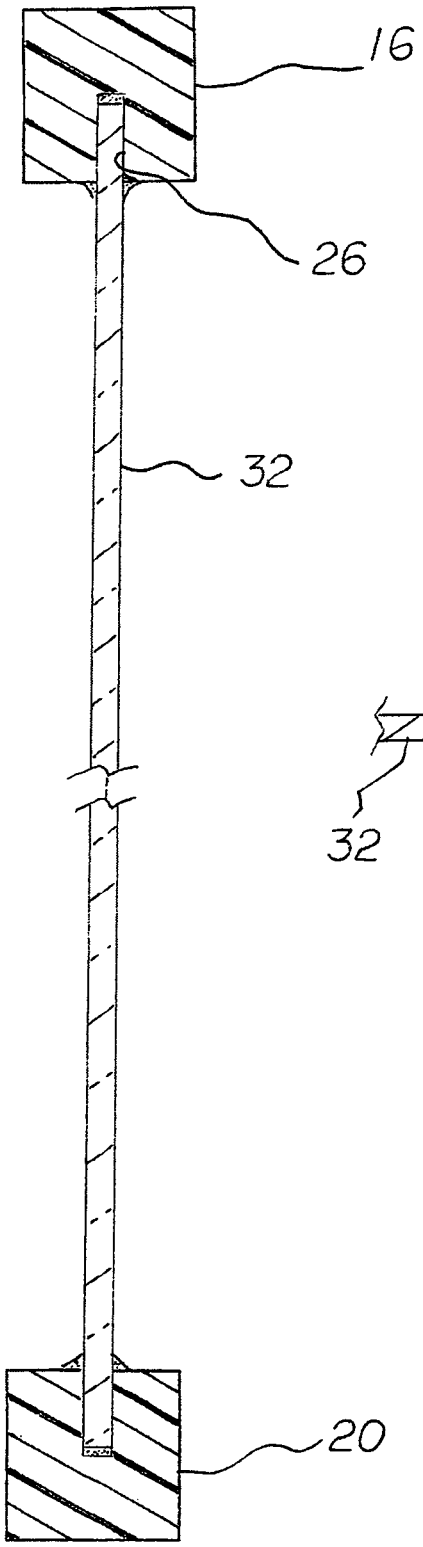
FIG. 3 is a cross sectional view of the system taken along line 3-3 of FIG. 1.
Figure 4:
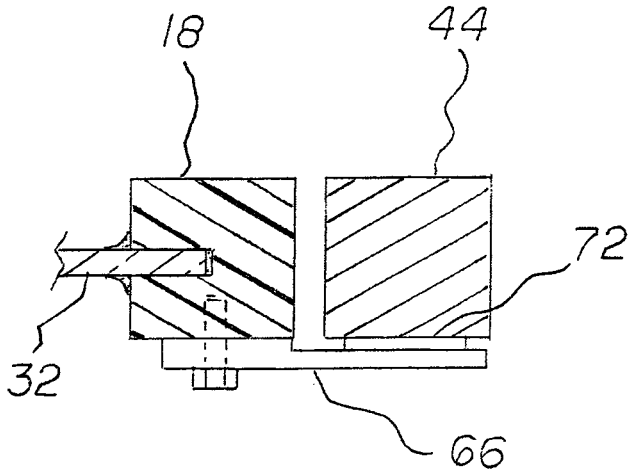
FIG. 4 is a plan view of a portion of the system taken along line 4-4 of FIG. 1.

With reference now to the drawings, and in particular to FIG. 1 thereof, the preferred embodiment of the new and improved latching gate system embodying the principles and concepts of the present invention and generally designated by the reference numeral 10 will be described.

The present invention, the latching gate system 10 is comprised of a plurality of components. Such components in their broadest context include an open latching gate, a panel insert, a first and second post and hinges. Such components are individually configured and correlated with respect to each other so as to attain the desired objective.

First provided is an open latching gate frame 14. The frame is configured in a rectangular configuration. The frame has an upper horizontal segment 16. The frame has two laterally spaced vertical segments 18. The frame has a lower horizontal segment 20. The upper horizontal segment and the lower horizontal segment have 45 degree chamfered lateral ends. The vertical segments have 45 degree chamfered upper ends. The vertical segments have 45 degree chamfered lower ends. Upper weldments 22 are provided. The upper weldments couple the lateral ends of the upper horizontal segment to the upper ends of the vertical segments. Lower weldments 24 are provided. The lower weldments couple the lateral ends of the lower horizontal segment to the lower ends of the vertical segments. Each segment has a generally rectangular cross sectional configuration. Each segment has an interiorly facing C-shaped indentation 26. In this manner the latching gate frame creates a rectangular channel 28. The indentations all have a common width and depth. The gate frame is fabricated of a clear, shatterproof, scratch resistant acrylic for superior operational characteristics.

A panel insert 32 is provided. The panel insert has a rectangular configuration. The panel insert has a width and a thickness essentially equal to the width and thickness of the indentations. The panel insert has an upper edge. The upper edge of the panel insert extends into the indentation of the upper horizontal segment. The panel insert has a lower edge. The lower edge extends into the indentation of the lower horizontal segment. The panel insert has side edges. The side edges extend into the indentations of the vertical segments. The panel insert is fabricated of a clear, shatterproof, scratch resistant acrylic for superior operational characteristics.

A latching gate base 36 is provided. The base is provided in a rectangular configuration. The base has two parallel length edges and two parallel width edges. The latching gate base has a length greater than the length of the horizontal segments. The latching gate base is adapted to be supported upon a recipient surface. The recipient surface is chosen from the class of recipient surfaces. The class of recipient surfaces includes carpets, tiles, concrete and any of a plurality of recipient floor surfaces. The gate base has an upper surface. The upper surface is configured to form bevels 38. The bevels extend from the length edges. In this manner movement across the gate base and through the system is facilitated. The latching gate base has a length and a width. The length is between 5 and 10 times the width. The gate base being fabricated of aluminum.

A first and a second vertically oriented, laterally spaced post 42, 44 is provided. Each post has a hollow rectangular configuration. Each post has an upper end 46. Each post has a lower end 48. The lower ends are welded to the gate base. The lower ends are separated by a post spacing. The post spacing is greater than the width of the gate frame. The posts are fabricated of aluminum.

Four securement apertures 52 are provided. The securement apertures extend through the gate base adjacent to each end. Eight securement screws 54 are provided. In this manner the system may be secured to the recipient surface. Four adjustment apertures 56 are provided. The adjustment apertures extend through the gate base adjacent to each end interiorly of the securement apertures. Eight adjustment screws 58 are provided. In this manner the exact positioning of the frame base to the recipient surface is allowed.

Provided next are three hinges 62. The three hinges pivotably couple the first post to an adjacent vertical segment of the gate frame and panel inset. The hinges are spring urged. The hinges function to reciprocate the gate frame and panel insert between open and closed orientations. The hinges further function to automatically close the gate frame and panel insert through spring loading.

Further provided is a central stop plate 66. Two end stop plates 68, 70 are provided. The stop plates are coupled to the vertical segment adjacent to the second post. The stop plates are adapted to contact the second post when in a closed orientation. The second post has a magnetic latch 72. In this manner the central stop plate may be contacted for automatic securement of the gate frame and panel insert.

Provided last is an upper adjustment fixture 76. In this manner the initial securement and alignment of the posts with respect to each other and with respect to the gate base and the gate frame and the panel insert is facilitated. The adjustment fixture is formed of a horizontal plank 78. Two downwardly extending stubs 80 are provided. The stubs are positionable in the upper ends of the posts.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A latching gate system comprising:

an open latching gate frame configured in a rectangular configuration with upper and lower horizontal segments and two laterally spaced vertical segments, each segment having an interiorly facing indentation;

a panel insert having a rectangular configuration supported by the indentations of the segments;

a first and a second vertically oriented, laterally spaced post having a hollow rectangular configuration; and hinges coupling the first post to an adjacent one of the two laterally spaced vertical segments of the gate frame and panel inset, the hinges being spring urged and functioning to reciprocate the gate frame and panel insert between open and closed orientations;

a latching gate base in a rectangular configuration with two parallel length edges and two parallel width edges, the latching gate base having a length greater than the length of the horizontal segments, the latching gate base adapted to be supported upon a recipient surface, the gate base having an upper surface configured to form bevels extending from the length edges to facilitate movement upwardly then horizontally then downwardly across the gate base and through the system, the latching gate base having a length and a width;

the first and second posts being fixed to the latching gate base, the first post defining a first inner face and the second post defining a second inner face; the latching gate base defining an interior base section located between the first inner face and the second inner face, a first base section on a first side of the interior base section, and a second outer base section on a second side of the interior base section, opposite the first outer base section;

eight securement apertures extending through the gate base with eight securement screws for securement of the system to the recipient surface, wherein four of the securement apertures are located within the first outer base section and the other four of the securement apertures are located within the second outer base section;

eight adjustment apertures extending through the gate base with eight adjustment screws to allow for exact positioning of the frame base to the recipient surface, wherein four of the adjustment apertures are located within the first outer base section interiorly of the four securement apertures located therein, and the other four of the adjustment apertures are located within the second outer base section interiorly of the four securement apertures located therein.

2. The system as set forth in claim 1 and further including:

a central stop plate and two end stop plates, the stop plates being coupled to the vertical segment adjacent to the second post, the stop plates adapted to contact the second post when in a closed orientation, a magnetic latch on the second post for being contacted by the central stop plate for automatic securement of the gate frame and panel insert.

3. The system as set forth in claim 1 and further including:

an upper adjustment fixture to facilitate initial securement and alignment of the posts with respect to each other and with respect to the gate frame and the panel insert, the adjustment fixture being formed of a horizontal plank and two downwardly extending stubs positionable in the upper ends of the posts.

4. A latching gate system (10) for controlling the location and movement of people such as travelers passing through airports, the controlling being achieved in a safe, secure, convenient and economical manner, the system comprising, in combination:

an open latching gate frame (14) configured in a rectangular configuration with an upper horizontal segment (16) and two laterally spaced vertical segments (18)

and a lower horizontal segment (20), the upper horizontal segment and the lower horizontal segment having 45 degree chamfered lateral ends, the vertical segments having 45 degree chamfered upper ends and 45 degree chamfered lower ends, upper weldments (22) coupling the lateral ends of the upper horizontal segment to the upper ends of the vertical segments, lower weldments (24) coupling the lateral ends of the lower horizontal segment to the lower ends of the vertical segments, each segment having a generally rectangular cross sectional configuration with an interiorly facing C-shaped indentation (26) whereby the latching gate frame creates a rectangular channel (28), the indentations all having a common width and depth, the gate frame being fabricated of a clear, shatterproof, scratch resistant acrylic;

a panel insert (32) having a rectangular configuration, the panel insert having a width and a thickness essentially equal to the width and thickness of the indentations, the panel insert having an upper edge extending into the indentation of the upper horizontal segment, the panel insert having a lower edge extending into the indentation of the lower horizontal segment, the panel insert having side edges extending into the indentations of the vertical segments, the panel insert being fabricated of a clear, shatterproof, scratch resistant acrylic for superior operational characteristics;

a latching gate base (36) in a rectangular configuration with two parallel length edges and two parallel width edges, the latching gate base having a length greater than the length of the horizontal segments, the latching gate base adapted to be supported upon a recipient surface chosen from the class of recipient surfaces including carpets, tiles, concrete and any of a plurality of recipient floor surfaces, the gate base having an upper surface configured to form bevels (38) extending from the length edges to facilitate movement across the gate base and through the system, the latching gate base having a length and a width, the length being between 5 and 10 times the width, the gate base being fabricated of aluminum;

a first and a second vertically oriented, laterally spaced post (42), (44), each post having a hollow rectangular configuration with an upper end (46) and a lower end (48), the lower ends being welded to the gate base and separated by a post spacing greater than the width of the gate frame, the posts being fabricated of aluminum;

the first post defining a first inner face and the second post defining a second inner face; the latching gate base defining an interior base section located between the first inner face and the second inner face, a first base section on a first side of the interior base section, and a second outer base section on a second side of the interior base section, opposite the first outer base section;

eight securement apertures extending through the gate base with eight securement screws for securement of the system to the recipient surface, wherein four of the securement apertures are located within the first outer base section and the other four of the securement apertures are located within the second outer base section;

eight adjustment apertures extending through the gate base with eight adjustment screws to allow for exact positioning of the frame base to the recipient surface, wherein four of the adjustment apertures are located within the first outer base section interiorly of the four securement apertures located therein, and the other four of the adjustment apertures are located within the second outer base section interiorly of the four securement apertures located therein;

three hinges (62) pivotably coupling the first post to an adjacent one of the two laterally spaced vertical segments of the gate frame and panel inset, the hinges being spring urged and functioning to reciprocate the gate frame and panel insert between open and closed orientations and to automatically close the gate frame and panel insert through spring loading;

a central stop plate (66) and two end stop plates (68), (70), the stop plates being coupled to the vertical segment adjacent to the second post, the stop plates adapted to contact the second post when in a closed orientation, a magnetic latch (72) on the second post for being contacted by the central stop plate for automatic securement of the gate frame and panel insert; and an upper adjustment fixture (76) to facilitate initial securement and alignment of the posts with respect to each other and with respect to the gate base and the gate frame and the panel insert, the adjustment fixture being formed of a horizontal plank (78) and two downwardly extending stubs (80), each stub positionable in the upper end of one of the posts.

* * * * *